US006453809B2

(12) United States Patent
Kempen

(10) Patent No.: US 6,453,809 B2
(45) Date of Patent: Sep. 24, 2002

(54) SQUEEGEE DEVICE

(75) Inventor: Henricus Gerardus M. Kempen, Ledeacker (NL)

(73) Assignee: Stork Brabant B.V., Boxmeer (NL)

( * ) Notice: Subject to any disclaimer, the term of this patent is extended or adjusted under 35 U.S.C. 154(b) by 0 days.

(21) Appl. No.: 09/755,434

(22) Filed: Jan. 5, 2001

Related U.S. Application Data

(63) Continuation of application No. PCT/NL00/00285, filed on May 2, 2000.

(30) Foreign Application Priority Data

May 7, 1999 (NL) ..... 1011992

(51) Int. Cl.[7] ..... B41L 13/00
(52) U.S. Cl. ..... 101/120; 101/126; 118/414
(58) Field of Search ..... 101/119, 120, 101/126; 118/413, 414

(56) References Cited

U.S. PATENT DOCUMENTS 3,566,784 A * 3/1971 Mitter ..... 101/120
3,592,132 A * 7/1971 Weber ..... 101/119
4,993,352 A * 2/1991 Zimmer ..... 118/112
4,998,500 A * 3/1991 Zimmer ..... 118/110
5,099,758 A 3/1992 Hassler et al.
5,151,132 A 9/1992 Zimmer
5,156,682 A * 10/1992 Zimmer ..... 101/119

FOREIGN PATENT DOCUMENTS

EP 0390771 A2 10/1990
WO WO 90/07387 12/1990

* cited by examiner

*Primary Examiner*—Ren Yan
(74) *Attorney, Agent, or Firm*—Hoffman & Baron, LLP

(57) ABSTRACT

Squeegee device for applying printing medium to a substrate, interacting with a squeegee element which is made at least partially from a magnetizable material and can be moved between an operating position and an at-rest position, which squeegee device comprises a support frame for delimiting an operating space, inside which the operating position of the squeegee element is located, and magnetic means which are provided on the support frame for generating a magnetic field at the location of a designated bearing-wall part of the support frame in order to pull the squeegee element onto the bearing-wall part in the at-rest position, in which device switching means are provided, which interact with the magnetic means in order to apply the magnetic field at the location of the bearing-wall part in a switched-on position and to substantially eliminate the magnetic field at the location of the bearing-wall part in a switched-off position.

22 Claims, 5 Drawing Sheets

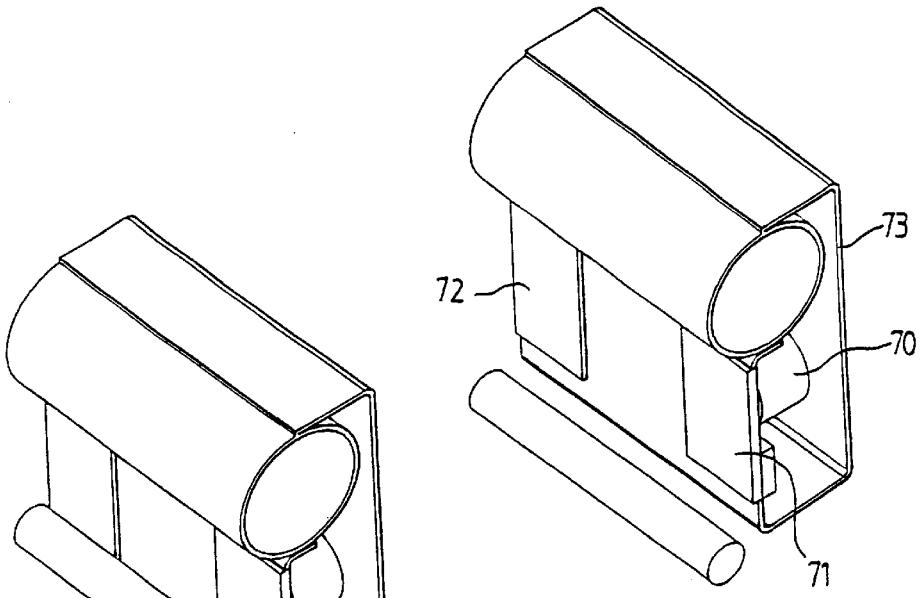
Fig. 7
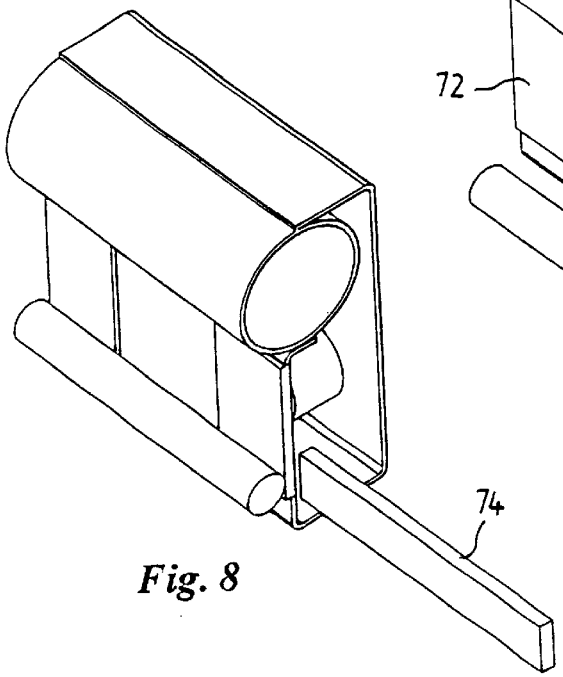
Fig. 8
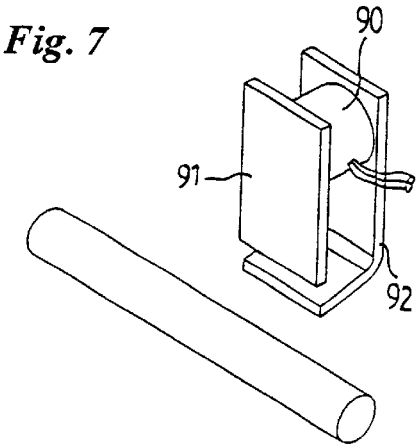
Fig. 9
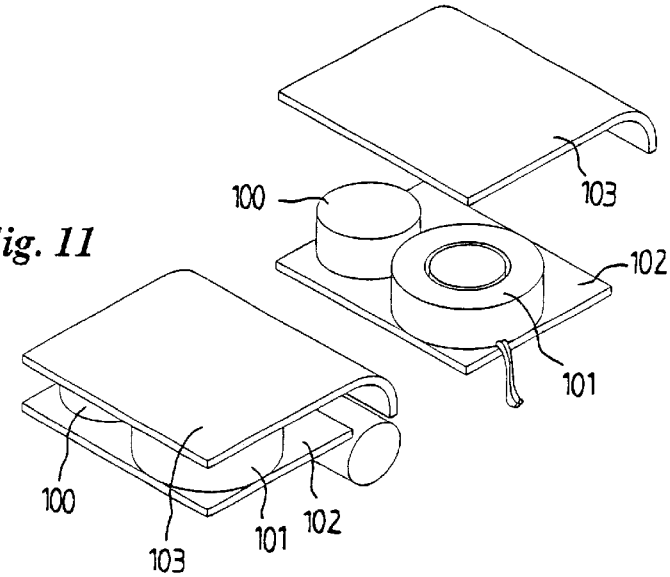
Fig. 11
Fig. 10

SQUEEGEE DEVICE

CROSS-REFERENCE TO RELATED APPLICATIONS

This is a continuation application of PCT/NL00/00285 filed May 2, 2000.

FIELD OF THE INVENTION

The invention relates to a squeegee device intended for use in a screen-printing device. By way of example, in a rotary screen-printing device, printing medium is pressed onto a substrate through a cylindrical stencil by means of a squeegee element. One type of squeegee element which is frequently used, in particular in textile printing, is the squeegee roller. In this case, the squeegee element is formed by a solid or hollow metal roller which, in an operating position, rests in the stencil at the location of the printing point. During the printing process, the stencil bears against the substrate which, in turn, is supported by substrate-conveyor means, for example a printing belt. Beneath the printing belt there is a magnetic beam, by means of which the squeegee roller is attracted firmly onto the stencil and the substrate. The squeegee roller is arranged in the stencil in such a way that it can move between the said operating position and an at-rest position, in which it is clear of the stencil. The at-rest position is desired, for example, during temporary interruption of a printing process during which the stencil is lifted off the substrate and continues to rotate while the substrate is at a standstill. The aim of this is to prevent leakage of printing medium out of the stencil and to prevent printing medium from drying inside the stencil. To prevent printing medium from being pressed out of the stencil in this situation, and to prevent excessive loads being imposed on the stencil, the squeegee roller should at this time not rest upon the stencil.

BACKGROUND OF THE INVENTION

By way of example, EP-A-0,408,704 has disclosed a squeegee device with an elongate support frame which can be accommodated in a screen-printing device suspension means located outside the stencil. On the support frame, there are a plurality of permanent magnets which are able to attract the squeegee roller and hold it in place when a magnetic field beneath the printing belt is removed. The squeegee roller then moves into the at-rest position, bearing against a designated wall part of the support frame. If the magnetic field beneath the printing belt is reapplied, this field has to be powerful enough to pull the squeegee roller off the permanent magnets in the support frame.

A drawback of this known squeegee device is that the permanent magnets in the support frame, during the printing process, exert a constant, considerable force on the squeegee roller, counteracting the attracting force of the magnetic beam beneath the printing belt. This translates into high demands being imposed on the strength of the squeegee device and leads to considerable difficulties in dimensioning the various magnetic fields with respect to one another. In an attempt to avoid these difficulties, in the state of the art squeegee device, according to EP-A-0 408,704 the permanent magnets are positioned in the support frame at a vertical distance above the bottom end of the support frame. However, this in turn has the drawback of attenuating the magnetic field at the location of the operating position. This is because, on the one hand the permanent magnets in the support frame have to be strong enough to lift the squeegee roller out of its operating position, and on the other hand the permanent magnets must not be too strong, in order to ensure that the magnetic beam beneath the printing belt is able to pull the squeegee roller out of its at-rest position on the support frame. It has been found that, in practice, it is not easily possible to satisfy both requirements at the same time in the squeegee device according to the state of the art. During the printing process, a considerable counteracting force is exerted constantly on the squeegee roller. As a result, it is difficult to allow the squeegee roller to run sufficiently clear from the support frame. Actually, the squeegee roller in the state of the art squeegee device maintains positive contact with the support frame at all times. As a result, the squeegee roller is braked, which results in excessive wear of support frame and squeegee roller, and imposes loads on the stencil. In order to avoid such disadvantageous contact, a gap must be set between the squeegee roller and the support frame during printing in the operating position. The gap width between the squeegee roller and the support frame will vary over the longitudinal direction of the squeegee device owing to deformations of the support frame caused by compensating counteracting forces. The gap width variation and the necessity to prevent contact between the squeegee roller and the support frame over the whole length of the squeegee, results in a gap width setting having local trajectories along part of the squeegee length with enlarged gap widths, with the risk of printing medium flowing onto the wrong side of the squeegee roller. A further drawback is that the magnetic beam beneath the printing belt can only pull the squeegee roller out of its at-rest position at relatively short distances. Consequently, outside the sphere of influence of the magnetic beam, the squeegee roller is always in the at-rest position.

SUMMARY OF THE INVENTION

The object of the invention is to overcome the above-mentioned drawbacks and, in particular, to provide a squeegee device which operates successfully and can also be used on existing screen-printing devices.

According to the invention, this object is achieved by means of a squeegee device according to claim 1. The squeegee device interacts with a squeegee element, for example a squeegee roller or squeegee blade, at least part of which is made from a magnetizable material. The squeegee element can move between an operating position and an at-rest position and is limited by a support frame. On the support frame, there are magnetic means for generating an attractive force from a magnetic field at the location of a bearing-wall part of the support frame. Furthermore there are switching means which interact with the magnetic means. In the switched-on position, the magnetic field is applied at the location of the bearing-wall part, while in the switched-off position the magnetic field is removed at the location of the bearing-wall part. The magnetic field is sufficiently strong to pull the squeegee element out of the operating position into the at-rest position against the bearing-wall part in the switched-on position. Advantageously, during a printing process the squeegee element is virtually only subject to a magnetic field which is generated beneath substrate-conveyor means, and the magnetic field from the support frame can then be switched off or removed. When the printing process is stopped, the magnetic field from the support frame can be switched on or applied, and the magnetic field beneath the substrate-conveyor means can be switched off or removed. As a result, counteraction of the magnetic forces is eliminated, and it is possible to impose less strict demands on the strength of the squeegee device. This device can be of more lightweight design, which is important in particular for long squeegee devices (broad printing widths), and also considerably increases ease of handling. In the operating position, the gap width between the squeegee element and the support frame can be kept within accurately defined limits. Deformations to the squeegee device caused by the magnetic forces counteracting one another no longer arise, making it possible to achieve gap widths of approximately 3 mm without there being any risk of the squeegee element running in contact with the support frame during the printing process. In the switched-on position, the magnetic field from the magnetic means on the support frame can be arranged as far as possible towards the bottom of the support frame and can be designed less powerful, since the distance between the operating position and the at-rest position is short. As a result, the magnetic means can be of more lightweight design. Furthermore, this shorter distance allows even roller squeegees of small to very small diameter to be picked up out of the printing medium and moved into the at-rest position.

In a preferred embodiment the magnetic means comprise one or several permanent magnets positioned in a row, for example mounted on a longitudinal holder body. With this the switching means comprise movement means for moving the permanent magnets between the switched-on and the switched-off position, for example towards and away from the designated bearing wall part against which the squeegee-element comes to lie in the at-rest position. The movement means may be constructed in a number of ways. In an advantageous embodiment the movement means comprise spring means for moving the permanent magnets into their switched-on position, and hydraulic or pneumatic means for moving the permanent magnets back into their switched-off position. As long as there is no pressure on the hydraulic or pneumatic means, the permanent magnets are being pushed by the spring means into the switched-on position. In this position the maximum magnetic force is present for holding the squeegee-element in its at-rest position. If subsequently pressure is built-up in the hydraulic or pneumatic pressure means, the magnets are forced backwardly to their switched-off position, and the squeegee element is given the freedom to move towards its operating position. This embodiment has the major advantage of being reliable, and easy to manufacture at low costs. In the case of a malfunction in the hydraulic or pneumatic pressure means, the squeegee-element is automatically forced into its at-rest position. This has the advantage that at all times it is possible to dismount and remove the squeegee device together with its squeegee element. There is no dependency on external energy sources like pressure or electrical means.

Other preferred embodiments of the invention are defined in claims 4–18.

The invention also relates to a screen-printing device according to claims 19 and 20 and a method for washing at a printing station of a screen-printing device according to claims 21 and 22 and to a squeegee with squeegee device and squeegee element according to claim 23.

BRIEF DESCRIPTION OF THE DRAWINGS

The invention will be explained in more detail with reference to the appended drawing, in which:

FIG. 7 shows a perspective view of a variant of the squeegee device shown in FIG. 1, with the squeegee element in an operating position;

FIG. 8 shows a view corresponding to that shown in FIG. 7, with the switching means in the switched-on position and with the squeegee element in an at-rest position;

FIG. 9 shows a perspective view of a variant of the magnetic means, with switching means in the switched-off position and with the squeegee element in an operating position;

FIG. 10 shows a perspective, exploded view of a variant of the magnetic means;

FIG. 11 shows a view corresponding to that shown in FIG. 10 in the assembled state and with the switching means in the switched-on position and with the squeegee element in the at-rest position;

DESCRIPTION OF THE PREFERRED EMBODIMENTS

Figure 1:
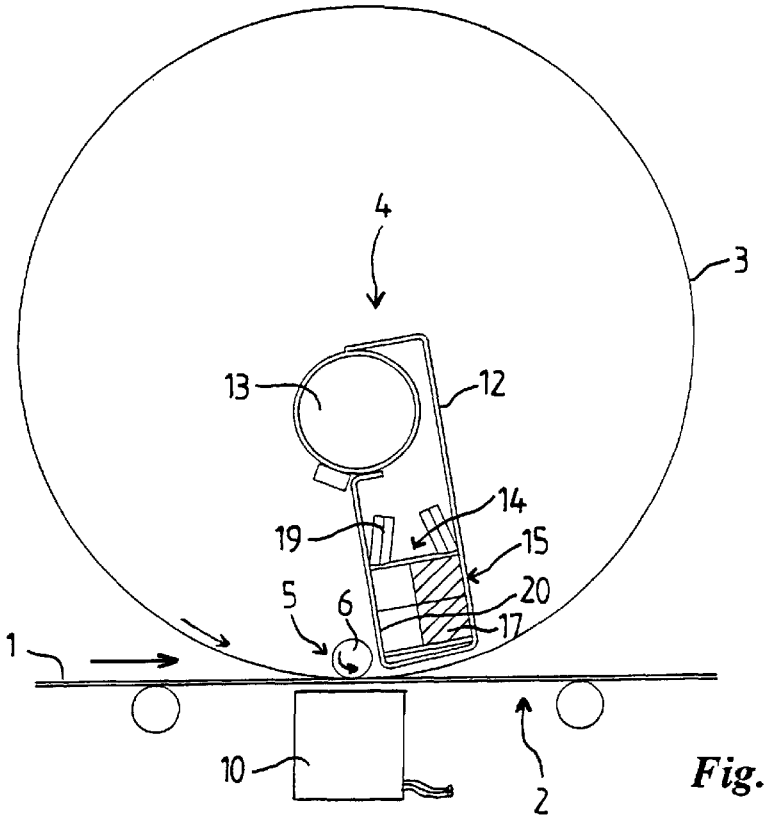
FIG. 1 diagrammatically depicts a cross section through a stencil in which there is a squeegee device according to the invention, with a squeegee element in an operating position.

FIG. 1 shows a printing station with a substrate 1 which is to be printed and is guided along a rotatable stencil 3 on substrate-conveyor means 2, which in this case comprise a printing belt which is guided over support rolls and end rolls. Inside the stencil 3, there is a squeegee device 4. The squeegee device 4 interacts with a squeegee element 5, which in this case is formed by a squeegee roller 6. The squeegee roller 6 is at least partially made from a magnetizable material and is formed, for example, by a solid or hollow metal roller. Beneath the substrate 1 there are actuatable magnetic means 10, for example a magnetic beam which extends parallel to the squeegee device. During a printing process, the magnetic beam 10 is switched on and the squeegee roller 6 is held bearing against the stencil 3 in an operating position, pulled firmly onto the stencil 3. The squeegee roller 6 begins to rotate with the driven stencil 3 and to build up pressure in the printing medium which lies in front of the squeegee roller 6, in the stencil 3. The operating position of the squeegee roller 6 lies inside an operating space which lies in front of the squeegee device 4, in the direction of printing, and is delimited by a support frame 12 of the squeegee device. The support frame 12 comprises a printing-medium distributor pipe 13 for feeding printing medium to one side of the squeegee roller 6. The support frame 12 prevents the printing medium from flowing onto the wrong side of the squeegee roller 6 and, for this purpose, during printing is in a position at a short distance from the squeegee roller 6. The squeegee roller 6 is clear of the support frame 12, so that the squeegee roller 6 can be driven freely by the stencil 3.

In the support frame 12 there are switching means 14 which interact with magnetic means 15. The switching means 14 are formed by a piston-cylinder system, in which a permanent magnet 17 of the magnetic means 15 can be moved to and fro as a piston inside a cylinder by building up a suitable hydraulic or pneumatic pressure on one of the two sides of the piston. For this purpose, the cylinder has two connection points 19 which can be connected to a pressure vessel via hoses with controlled valves. In the process, the permanent magnet 17 moves between a switched-on position and a switched-off position. In the switched-off position (FIG. 1), the permanent magnet 17 is located on the rear side of the support frame 12. The highest concentration of the magnetic field from the permanent magnet 17 is then substantially removed from the front side of the support frame 12, with the result that its influence on the squeegee roller 6 is low. Owing to the force of gravity and/or the attractive force of the magnetic beam 10, the squeegee roller 6 will move into the operating position and will contribute to the printing process. In the switched-on position (FIG. 2), the permanent magnet 17 is located on the front side of the support frame 12, just behind a designated bearing-wall part 20. In this position, the magnetic field from the permanent magnet 17 has its maximum concentration at the wall part 20 and is then at least sufficiently great to lift the squeegee roller 6 upwards out of the operating position into an at-rest position, in which the squeegee roller 6 bears against the wall part 20. Advantageously, the magnetic beam 10 and the magnetic means 15 are only switched on alternately, so that there are no forces which counteract one another exerted on the squeegee roller 6.

The embodiment of the magnetic means 15 having the permanent magnet 17 has the considerable advantage that the permanent magnet 17, once it has been moved into the switched-on position, continues to pull the squeegee roller 6 onto the wall part 20, even if the entire squeegee device 4 is removed from the stencil 3. For this purpose, the piston-cylinder system does not have to remain connected to the external energy source (pressure vessel), the pressure only being required for switching purposes. The same advantage is reached with the preferential embodiment of the squeegee device according to FIGS. 13 to 16 (see below).

Figure 2:
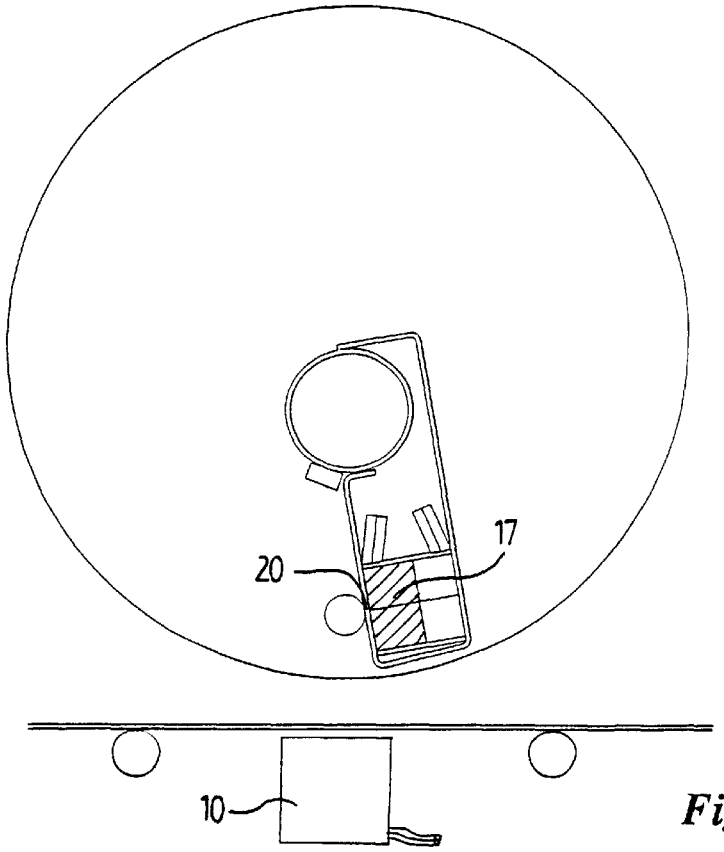
FIG. 2 shows a view corresponding to that of FIG. 1, with the squeegee element in an at-rest position.

As can be seen from FIGS. 1 and 2, the magnetic means 15 are arranged at the bottom of the support frame 12. The distance between the squeegee roller 6 in the operating position and the magnetic means 15 is consequently advantageously minimal, with the result that the permanent magnet 17, in the switched-on position, only has to bridge a short distance and can be of relatively weak and lightweight design. The same advantage is obtained with the squeegee device in the preferential embodiment according to FIGS. 13 to 16 (see below).

In addition to the piston-cylinder systems shown, the permanent magnets may also be moved to and fro by means of other types of movement means, for instance according to FIGS. 13 to 16 (see below).

Figures 3, 4, 5, 6:
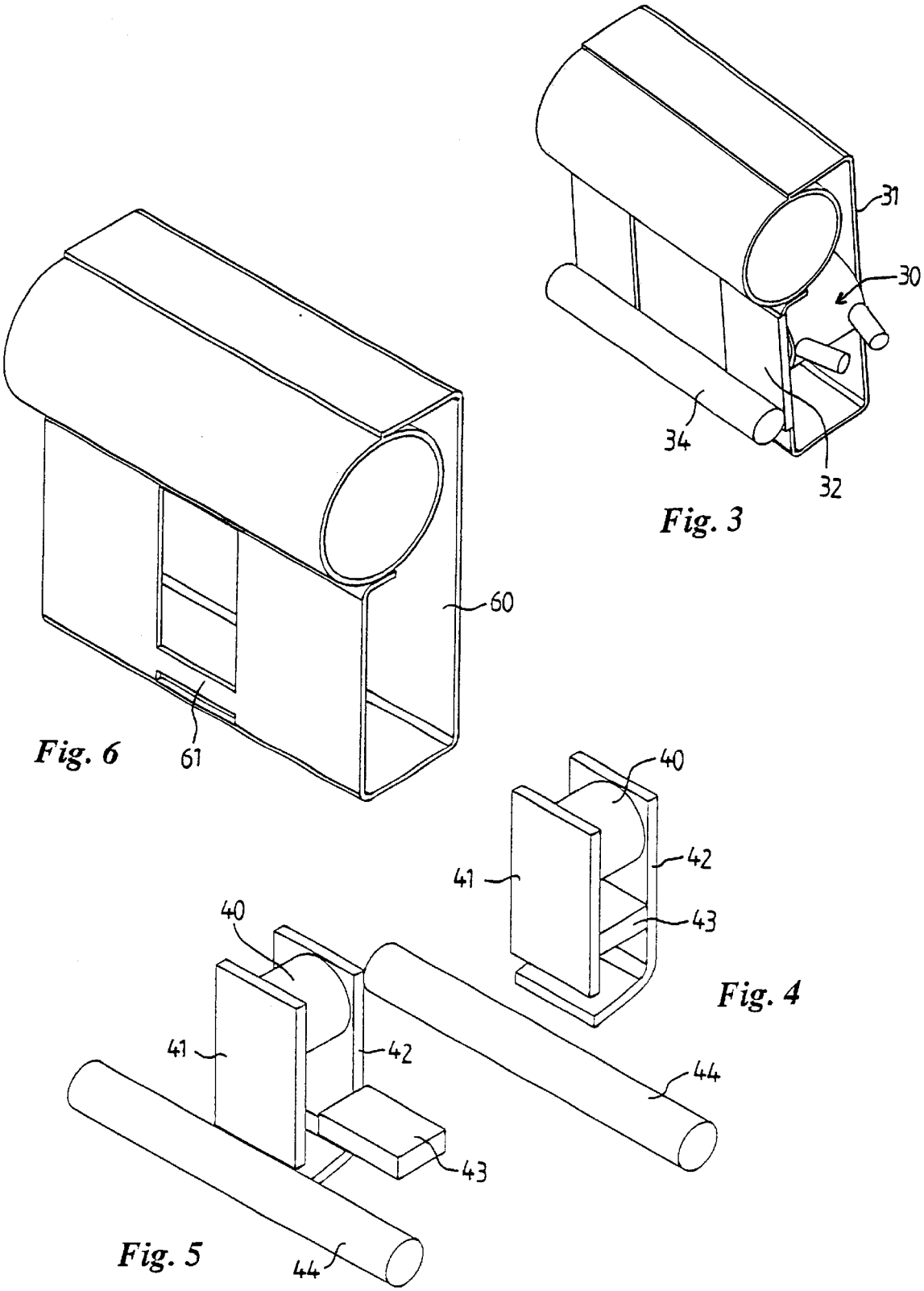
FIG. 3 shows a perspective view of a variant of the squeegee device shown in FIG. 1, with the squeegee element in an at-rest position.
FIG. 4 shows a perspective view of a variant of the magnetic means with switching means in the switched-off position.
FIG. 5 shows a view corresponding to that shown in FIG. 4, with the switching means in the switched-on position.
FIG. 6 shows a perspective view of a support frame.

FIG. 3 shows a variant in which the magnetic means 30 are positioned further up the support frame 31. The magnetic means 30 in this case comprise two permanent magnets which are arranged next to one another and can be moved to and fro, in piston-cylinder systems, between a switched-on position and a switched-off position. The permanent magnets are arranged in such a manner with respect to one another that opposite poles face towards the front side of the support frame 31. On the front side of the support frame 31 there are two flux concentrator bodies 32, for concentrated transmission of the magnetic field from the magnetic means 30 to a bearing-wall part further down the support frame 31. In the switched-on position, both permanent magnets bear against the flux concentrator bodies 32, and the squeegee roller 34 is pulled into the at-rest position against the designated bearing-wall part.

In a variant which is not shown, the magnetic means comprise one or more fixedly arranged permanent magnets. In this case, the magnets are positioned at a relatively great distance from a designated bearing-wall part of a support frame. The switching means comprise a movable flux concentrator body. In the switched-on position, one end of the body bears against a magnet pole, while its free end opens out in the vicinity of the bearing-wall part. In the switched-off position, the body no longer bears against the magnet pole and/or its free end opens out at a distance from the bearing-wall part. An opposite magnet pole may adjoin a movable flux concentrator body of a similar type or a fixedly arranged flux concentrator body.

In FIGS. 4 and 5, the magnetic means are formed by a permanent magnet 40, both magnet poles of which are guided via flux concentrator bodies 41 and 42 to a desired point and open out at a short distance from one another. The magnetic means interact with switching means which in this case comprise a movable flux concentrator body 43. In FIG. 4, the bodies 41 and 42 half-way are short-circuited by the flux concentrator body 43. In this switched-off position, the magnetic field which is derived from the permanent magnet 40 will select the shortest route and will run substantially via the bodies 41, 42 and 43. In this position, the squeegee roller 44 is not sufficiently attracted to be lifted upwards and moves into its operating position. In FIG. 5, the flux concentrator body 43 has moved towards the switched-on position, in which it no longer bears against the bodies 41, 42. In this position, the maximum concentration of the magnetic field reaches the air gap which is left clear between the free ends of the bodies 41 and 42, where it pulls the squeegee roller 44 upwards into its at-rest position. The magnetic means as shown in FIGS. 4 and 5 may, for example, be accommodated in a support frame 60 as shown in FIG. 6. In this case, the bearing-wall part 61 is situated in the bottom part of the front side of the support frame 60 and, in the fitted position, is delimited by the free ends of the bodies 41 and 42.

In FIGS. 7 and 8, the magnetic means comprise at least two permanent magnets 70 which are arranged in a fixed position next to one another and opposite poles of which, on the front side, adjoin flux concentrator bodies 71 and 72, which are likewise arranged in a fixed position. Inside the support frame 73 there is a movable flux concentrator body 74 which, in the switched-off position, short-circuits the bodies 71 and 72 (FIG. 7) and releases them in the switched-on position (FIG. 8).

Both in the embodiment shown in FIGS. 4 and 5 and in that shown in FIGS. 7 and 8, a plurality of or a plurality of pairs of fixedly arranged permanent magnets may be provided in a single support frame, which magnets can be switched centrally using a single movable flux concentrator body. As an alternative to being moved in the longitudinal direction, the flux concentrator body may also be moved in any other desired direction, for example in a direction which is transverse with respect to the support frame.

In FIG. 9, the magnetic means comprise an electromagnet 90. The electromagnet 90 can be switched on and off with the aid of a suitable switch. In this case too, the respective magnet poles are concentrated and transmitted to a desired location by means of fixedly positioned flux concentrator bodies 91 and 92. The electromagnet 90 is very simple to actuate and has the advantage that the entire magnetic field is eliminated in the switched-off position.

In a variant, the electromagnet 90 is designed with a magnetizable magnet core which retains its magnetic properties for a certain time after the current has been cut off, for example while squeegees are being stored. The electromagnet 90 may in that case comprise a coil in which there is a core of permanently magnetizable material, which material can also be brought into a permanent virtually demagnetized state, switching between the magnetized and demagnetized states of the core material being brought about by temporarily energizing the coil in order to magnetize or demagnetize the core material. An electromagnet 90 of this nature simply has to be energized only temporarily, during switching only, after which the core material remains in the magnetized or demagnetized state for a reasonably long time. In this embodiment, the flux concentrator bodies 91 and 92 can be omitted, and the electromagnet 90 (coil with core) can be positioned in the bottom of the support frame of the squeegee device.

FIGS. 10 and 11 show a variant in which a permanent magnet 100 and an electromagnet 101 are arranged next to one another, both with their poles adjoining flux concentrator bodies 102 and 103. The permanent magnet 100 and the electromagnet 101 may be designed in such a manner that the magnetic fields substantially cancel one another out as soon as the electromagnet 101 is switched on. Switching on the electromagnet 101 in this case means that the magnetic means are switched off altogether. In the switched-on position of the magnetic means, i.e. the switched-off position of the electromagnet 101, the permanent magnet 100 creates a magnetic field which is strong enough to attract a squeegee element and lift it up into the at-rest position.

In a variant, the switching of the electromagnet 101 is carried out in such a manner that both current directions are possible, and the electromagnet 101 is designed as a coil in which there is a core made from a material which can be magnetized permanently in each of two opposite directions as desired. As a result of the coil being temporarily energized in a desired current direction, it is possible for the direction of the permanent magnetization of the core to be set parallel to or opposite to the magnetic field direction of the permanent magnet 100, with the result that the magnetic fields are summed or short-circuited. It is then possible, in one position, to enable the magnetic fields of the permanent magnet 100 and the core of the electromagnet 101 to enhance one another, and in the other position, to enable the magnetic fields of the permanent magnet 100 and the core of the electromagnet 101 to substantially cancel one another out. This embodiment has the advantage that, after the magnetic fields have been connected in parallel, the two magnets together exert a very considerable attractive force on the squeegee element. It is then easy to lift the squeegee element from the operating position into the at-rest position. As soon as the squeegee element is in the operating position or the at-rest position, the current passing through the coil of the electromagnet 101 can be switched off entirely, since the permanent magnetization of the core of the electromagnet 101 is then maintained permanently, either oppositely to or parallel to the magnetic field of the permanent magnet. This in turn has the considerable advantage that the squeegee device, together with the squeegee element bearing against it in its at-rest position, can be removed from the stencil without having to maintain electric connection between the electromagnet and a current source. Furthermore, it is equally unnecessary to provide current during printing in the operating position. Temporary energizing is only required for switching. If the squeegee element is to be moved into its operating position, the magnetic field direction through the core of the electromagnet 101 is reversed, with the result that the magnetic fields cancel one another out and release the squeegee element.

In another embodiment, the permanent magnet 100 and the electromagnet 101 (with coil and core with bistable, reversible permanent magnetization) could also be placed against one another, so that they are then in series with magnetic fields which are connected in parallel or antiparallel. In that case, the flux concentrator bodies 102 and 103 could be omitted and the permanent magnet 100, together with the series-connected electromagnet 101, could then be placed in the bottom of the support frame of the squeegee device, with the permanent magnet 100 or the electromagnet 101 adjoining the bearing-wall part 20. A squeegee device according to this embodiment operates in a similar way to that described in the preceding paragraph.

In addition to interacting with the squeegee roller shown, the squeegee device according to the invention may also interact with a different type of squeegee element, for example a blade squeegee element which is provided with a squeegee blade. It is important that the blade squeegee element should be at least partly made from a magnetizable material.

Figure 12:
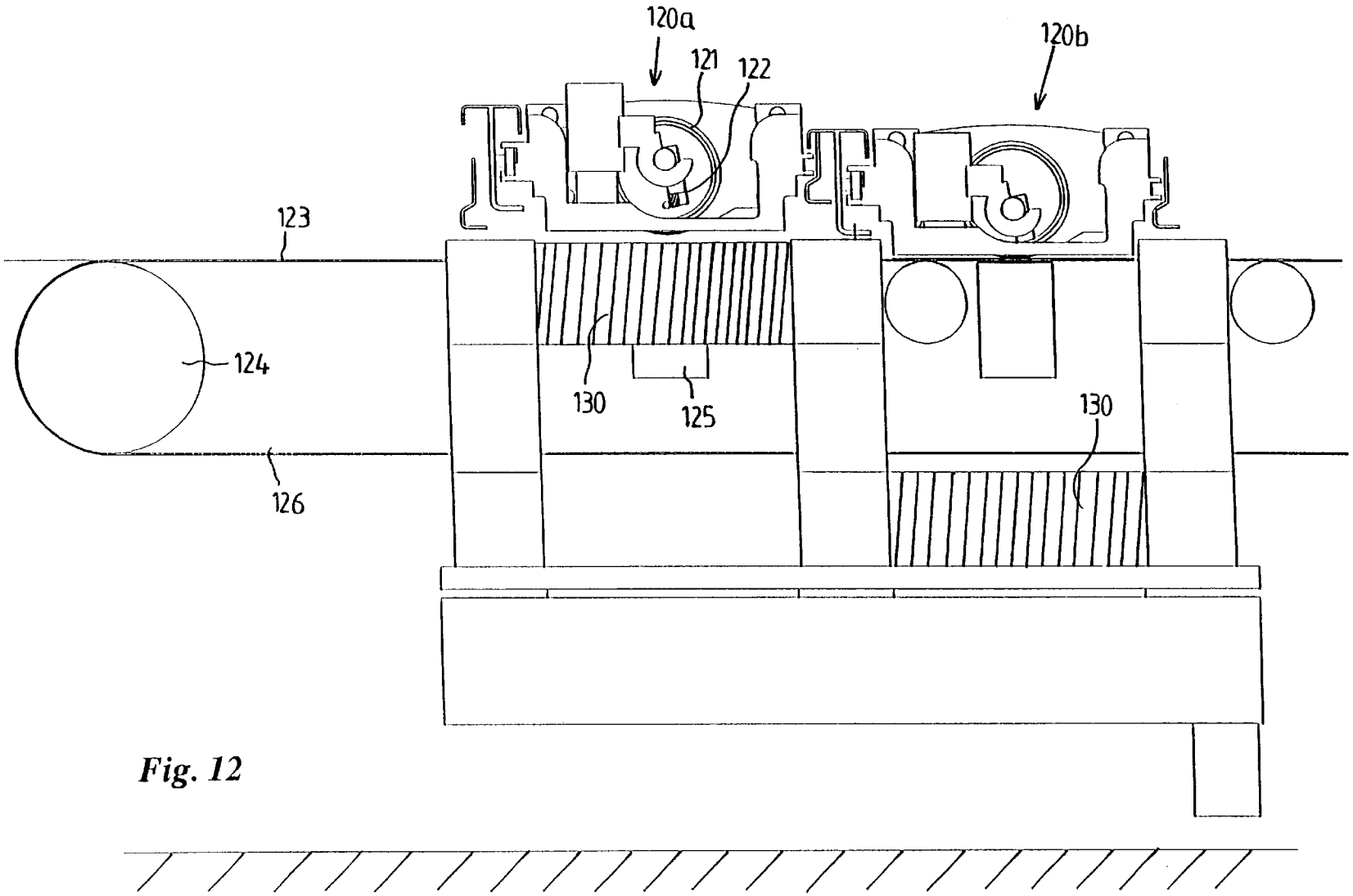
FIG. 12 shows a diagrammatic side view of a preferred embodiment of a screen-printing device according to the invention.

FIG. 12 shows a small part of a screen-printing device. The device comprises printing stations 120, each having a removable stencil 121 in which there is a squeegee device 122 according to the invention. A substrate 123 is guided past the printing stations 120 by means of substrate-conveyor means. In fact, for the duration of its passage through the printing device, the substrate is temporarily stuck to an endless printing belt 126 which runs over end rolls 124 and further support rolls, through the printing device, as is generally known in rotary screen-printing techniques, for example for the continuous printing of textile substrates in web form. Actuatable magnetic means, for example a magnetic beam 125, are provided beneath the substrate 123. The stencil 121 with squeegee device 122 can be moved with respect to the substrate 123 between a printing position and an inactive position. The inactive position is in this case illustrated for printing station 120*a*, while the printing position is illustrated for printing station 120*b*. For each printing station 120 a movable shutter 130 is provided which can move between a parked position (printing station 120*b*) and a shut off position (printing station 120*a*). In the shut off position, the shutter 130 forms a protective shutter between the underside of the stencil 121 and the substrate 123. In this position, the stencil 121 and/or the squeegee device 122 can be wetted or washed. Advantageously, the switching ability of the magnetic means in the support frame of the squeegee device 122 is used for this purpose. During washing of the stencil 121 and/or the squeegee device 122, washing liquid is supplied. Depending on the dirtiness and the washing stage, the squeegee element may optionally be moved into its operating position or may be moved to and fro repeatedly between its operating position and its at-rest position by appropriate switching of the magnetic means in the support frame. As a result, the washing process can be accelerated and improved considerably. The shutters 130 ensure that the washing liquid is collected and discharged without coming into contact with the substrate 123. According to the invention, the operating position may also advantageously be reached while the stencil 121 and the squeegee device 122 are at a relatively great distance from the magnetic beam 125 and are separated therefrom by a shutter 130.

In FIGS. 13–16 a squeegee device 140 is shown. The squeegee device 140 interacts with a squeegee element 141. The squeegee device 140 comprises a support frame 142. Inside the support frame 142 a longitudinal holder body 143 is present, in which holder body 143 several permanent magnets 144 are fixedly held. Between the back side of the holder body 143 and the support frame 142 spring means 145 are placed. In the embodiment shown the spring means 145 are formed by a longitudinal leaf spring made of resilient steel. Thus one spring element suffices for one holder body. Between the front side of the holder body 143 and the support frame 142 hydraulic or pneumatic means 146 are provided (see FIG. 15). In the embodiment shown the hydraulic or pneumatic means 146 are formed by a longitudinal air inflatable tire, the tire being connectable to means for building up pressure.

Figure 13:
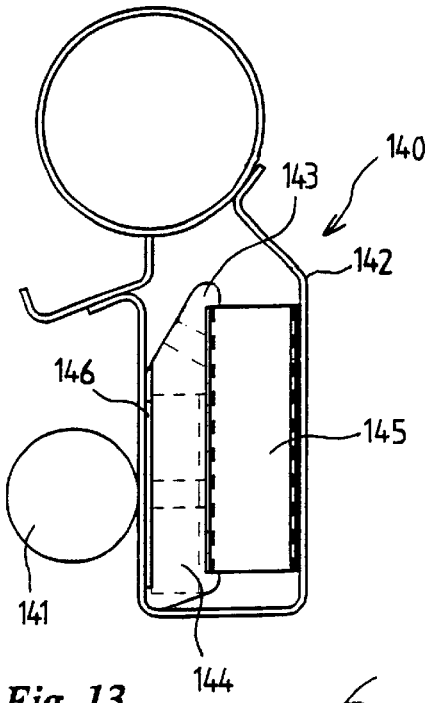
FIG. 13 diagrammatically shows a cross section of a preferential embodiment of the squeegee device, with the squeegee element in an at-rest position.
Figure 14:
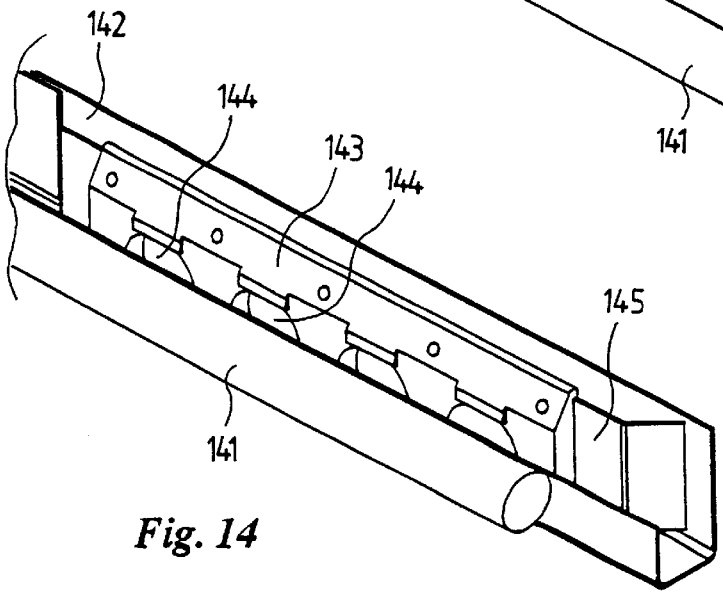
FIG. 14 shows a perspective view of the lower part of the squeegee device in FIG. 13.

In FIGS. 13 and 14 the situation is shown in which there is substantially no pressure on the inflatable tire. The leaf spring pushes the holder body 143 together with the permanent magnets 144 against the front side of the support frame 142. The holder body 143 advantageously comprises a recess 148 in which the flat tire 146 can lie. In this switched-on position, the magnetic field from the row of permanent magnets 144 has its maximum concentration at the front side of the squeegee device 140, and is then sufficiently strong to lift the squeegee element 141 upwards into an at-rest position.

Figure 15:
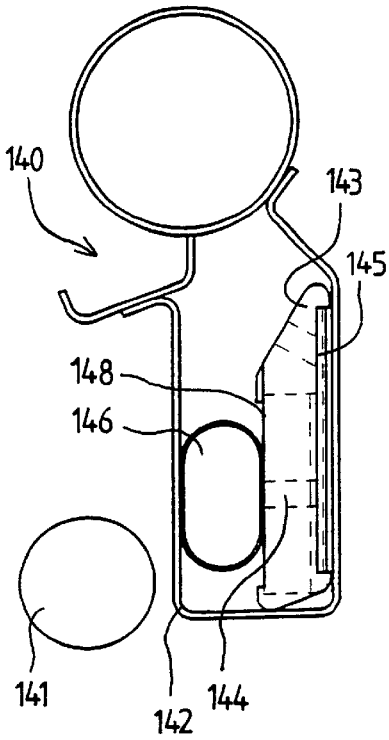
FIG. 15 shows a view corresponding to that of FIG. 13, with the squeegee element in an operation position.
Figure 16:
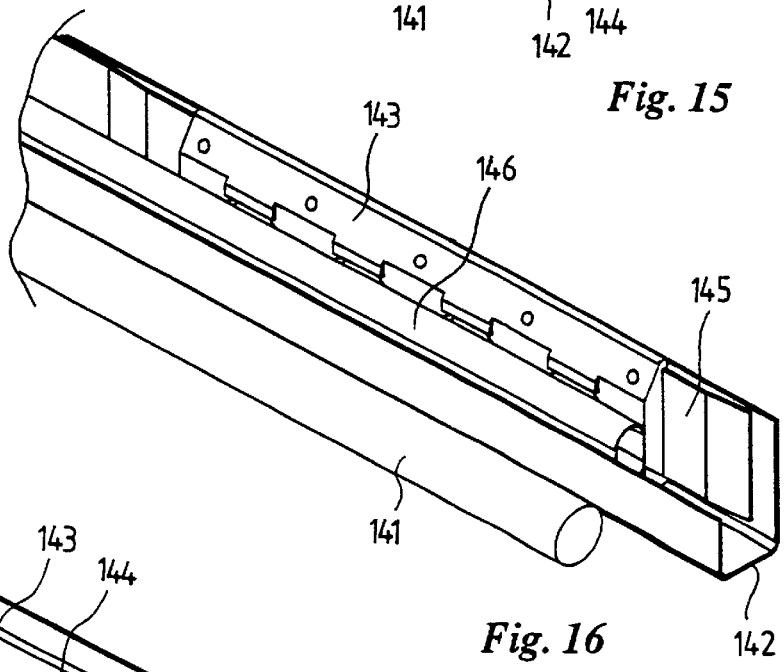
FIG. 16 shows a view corresponding to that of FIG. 14, with the squeegee element in the operating position.

In FIGS. 15 and 16 the situation is shown in which the tire has been inflated. The tire pushes the holder body 143 together with the permanent magnets 144 against the backside of the support frame 142, the leaf spring being pushed into a more flat position in which it lies in a recess provided in the backside of the holder body 143. In this switched-off position, the magnetic field from the row of permanent magnets 144 has its maximum concentration at the backside of the squeegee device 140, and from there it has little influence on the squeegee element 141, which then has the freedom to move into its operating position in order to contribute to a printing or washing process.

According to the invention it is possible for the means for moving a squeegee element to and fro between an operating position and an at-rest position inside a stencil of a screen-printing device to be of lightweight, inexpensive and simple design. This is the case for both the magnetic means in the support frame of the squeegee device and the magnetic means which are arranged beneath the substrate (for example a magnetic beam). The switching ability of the magnetic means in the support frame advantageously prevents the situation of magnetic fields which counteract one another and may advantageously also be employed outside the printing process, for example during a washing treatment. The avoidance of magnetic fields which counteract one another decreases the mutual magnetic forces exerted by the squeegee element in its operating position and the support frame of the squeegee device upon each other, and thus increases the accuracy of metering of printing medium during a printing process, since the position of the squeegee element with respect to the stencil and with respect to the support frame can be controlled with a very high level of accuracy.

In addition to the embodiment shown, numerous variants are possible. For example, the magnetic means in the support frame may also comprise combinations of variants arranged next to one another.

What is claimed is:

1. Squeegee assembly for use in a screen printing device for applying printing medium to a substrate, comprising:

a squeegee element comprising a magnetizable material and a squeegee element positioning device interactable with said squeegee element, said squeegee element positioning device comprising:

(a) a support frame; and (b) a switchable first magnetic means provided on said support frame; wherein said squeegee element is movable between an operating position and an at-rest position with respect to said support frame; and (c) a switching means for switching said first magnetic means between a switched-on position and a switched-off position, wherein said switched-on position is defined as the state in which said first magnetic means apply or generate a magnetic field at a location of a designated bearing-wall part of said support frame in order to pull said squeegee element onto said bearing-wall part in said at-rest position, and further wherein said switched-off position is defined as the state in which said magnetic field from said first magnetic means is substantially eliminated or removed at the location of said bearing-wall part of said support frame in order to give said squeegee element the freedom to move in said operating position.

2. Squeegee assembly according to claim 1, in which said first magnetic means comprise at least one permanent magnet, and said switching means comprise movement means for moving said permanent magnet to and fro with respect to said bearing-wall part of said support frame.

3. Squeegee assembly according to claim 2, in which said movement means comprise spring means for moving said permanent magnet to said switched-on position, and hydraulic or pneumatic means for moving said permanent magnet to said switched-off position.

4. Squeegee assembly according to claim 3, in which said hydraulic or pneumatic means comprise an inflatable flexible body.

5. Squeegee assembly according to claim 4, in which said spring means comprise a leaf spring.

6. Squeegee assembly according to claim 4, wherein said inflatable flexible body is an air-inflatable tire or bellows.

7. Squeegee assembly according to claim 2, in which said movement means comprise a double-acting piston-cylinder system.

8. Squeegee assembly according to claim 1, in which said magnetic means comprise at least one permanent magnet, and said switching means comprise an at least partially movable flux concentrator body, for concentrated transmission of the magnetic field from a magnet pole to said bearing-wall part in said switched-on position, and for diverting the magnetic field from said bearing-wall part in said switched-off position.

9. Squeegee assembly according to claim 1, in which said magnetic means comprise at least one permanent magnet, and said switching means comprise an at least partially movable flux concentrator body for short-circuiting two opposite magnet poles in said switched-off position and enabling two opposite magnet poles in said switched-on position.

10. Squeegee assembly according to claim 1, in which said magnetic means comprise at least a first and second permanent magnet, and said flux concentrator body short-circuits two opposite magnet poles of said first and second magnets in said switched-off position.

11. Squeegee assembly according to claim 1, in which said magnetic means comprise at least one electromagnet, and said switching means comprise a switch for breaking a circuit leading to said electromagnet in said switched-off position.

12. Squeegee assembly according to claim 1, in which said magnetic means comprise at least one electromagnet, which electromagnet comprises a coil in which there is a core of permanently magnetizable material or a core of permanently virtually demagnetized material.

13. Squeegee assembly according to claim 1, in which said magnetic means comprise at least one permanent magnet and an electromagnet, which electromagnet comprises a coil in which there is a core of permanently magnetic material, the direction of magnetization of which can be connected parallel to or opposite to the magnetic field direction of said permanent magnet, in which said switching means comprise a switch for breaking and reversing a circuit leading to said coil of said electromagnet, and in which the magnetic fields of said permanent magnet and said core of said electromagnet substantially cancel one another out in said switched-off position.

14. Squeegee assembly according to claim 13, in which the magnetic fields of said permanent magnet and said core of said electromagnet intensify one another in said switched-on position.

15. Squeegee assembly according to claim 1, in which one or more flux concentrator bodies are provided for transmitting the magnetic fields to said bearing-wall part in said switched-on position.

16. Squeegee assembly according to claim 1, in which said squeegee element is a squeegee roller having a solid or hollow metal roller.

17. Squeegee assembly according to claim 1, in which a plurality of magnets are provided next to one another in the longitudinal direction.

18. Squeegee assembly according to claim 17, in which said plurality of magnets are arranged in such a manner that in each case opposite poles lie next to one another.

19. Screen-printing device for printing a substrate, comprising:

at least one printing station having a removable stencil, a printing-medium feed and a squeegee assembly according to claim 1;

a substrate-conveyor means for guiding a substrate past said printing station;

an actuatable second magnetic means provided beneath said substrate-conveyor means or beneath a substrate guided over them for pulling said squeegee element into said operating position in a switched-on position; and an actuating means for switching said first magnetic means to said switched-off position for substantially removing the magnetic field from said first magnetic means in said support frame at the location of said bearing-wall part when said second magnetic means beneath said substrate-conveyor means are switched on.

20. Screen-printing device according to claim 19, further comprising:

a movement mechanism for moving said stencil, together with said squeegee element supporting device with associated squeegee element, and said substrate-conveyor means with respect to one another, between a printing position and an inactive position; and a shutter which can be moved between a parked position and a shut off position, wherein said shutter in the shut off position forms a protective shutter between said stencil and said substrate-conveyor means or a substrate being guided over them.

21. Method for washing at a printing station of a screen-printing device comprising:

(a) providing at least one printing station having a removable stencil, a printing-medium feed and a squeegee assembly according to claim 1;

(b) providing a substrate-conveyor means;

(c) guiding a substrate past said printing station with said substrate-conveyor means;

(d) providing an actuatable second magnetic means beneath said substrate-conveyor means or beneath a substrate guided over them;

(e) using said actuatable second magnetic means to pull said squeegee element into said operating position in a switched-on position;

(f) providing an actuating means;

(g) using said actuating means to switch said first magnetic means to said switched off position;

(h) substantially removing the magnetic field from said first magnetic means in said support frame at the location of said bearing-wall part when said second magnetic means beneath said substrate-conveyor means are switched on, wherein the magnetic field from said first magnetic means is optionally removed or applied or alternately removed and applied, in a repeating sequence, in said support frame at the location of said bearing-wall part, to place said squeegee element into and lift it out of said stencil; and (i) feeding washing liquid to said printing station for washing said printing station.

22. Method for washing at a printing station of a screen-printing device comprising:

(a) providing at least one printing station having a removable stencil, a printing-medium feed and a squeegee assembly according to claim 1;

(b) providing a substrate-conveyor means;

(c) guiding a substrate past said printing station with said substrate-conveyor means;

(d) providing an actuatable second magnetic means beneath said substrate-conveyor means or beneath a substrate guided over them;

(e) using said actuatable second magnetic means to pull said squeegee element into said operating position in a switched-on position;

(f) providing an actuating means;

(g) using said actuating means to switch said first magnetic means to said switched-off position;

(h) substantially removing the magnetic field from said first magnetic means in said support frame at the location of said bearing-wall part when said second magnetic means beneath said substrate-conveyor means are switched on, wherein the magnetic field from said first magnetic means is optionally removed or applied or alternately removed and applied, in a repeating sequence, in said support frame at the location of said bearing-wall part, to place said squeegee element into and lift it out of said stencil;

(i) providing a movement mechanism;

(j) using said movement mechanism to move said stencil, together with said squeegee element supporting device with associated squeegee element, and said substrate-conveyor means with respect to one another, between a printing position and an inactive position;

(k) providing a shutter which can be moved between a parked position and a shut off position, wherein said shutter in the shut off position forms a protective shutter between said stencil and said substrate-conveyor means or a substrate being guided over them;

(l) placing said stencil, together with said squeegee element supporting device, in the inactive position;

(m) placing said shutter in the shut off position;

(n) removing or applying, or alternately removing and applying, in a repeating sequence, the magnetic field from said. first magnetic means in said support frame at the location of said bearing-wall part;

(o) moving said squeegee element between said operating position in said stencil and said at-rest position on said support frame; and (p) feeding a washing liquid to said printing station for washing said printing station.

* * * * *